US008002304B2

(12) United States Patent
Heil et al.

(10) Patent No.: US 8,002,304 B2
(45) Date of Patent: Aug. 23, 2011

(54) SNOW GLIDE BOARD AND SHELL ELEMENT FOR A SNOW GLIDE BOARD

(75) Inventors: Tobias Heil, Mitterfeis (DE); Andreas Ametsbichler, Straubing (DE)

(73) Assignee: Marker Völkl International GmbH, Baar (CH)

( * ) Notice: Subject to any disclaimer, the term of this patent is extended or adjusted under 35 U.S.C. 154(b) by 729 days.

(21) Appl. No.: 11/600,023

(22) Filed: Nov. 16, 2006

(65) Prior Publication Data

US 2007/0108733 A1 May 17, 2007

(30) Foreign Application Priority Data

Nov. 16, 2005 (DE) ..... 10 2005 054 985

(51) Int. Cl.
*A63C 5/07* (2006.01)

(52) U.S. Cl. ..... 280/602; 280/601; 280/609

(58) Field of Classification Search ..... 280/601, 280/602, 609, 610, 11.14, 809
See application file for complete search history.

(56) References Cited

U.S. PATENT DOCUMENTS

| | | | | | |
|---|---|---|---|---|---|
| 2,164,604 | A * | 7/1939 | Whiteford | 280/610 |
| 3,132,874 | A * | 5/1964 | Baudou | 280/610 |
| 3,300,226 | A * | 1/1967 | Reed, Jr. | 280/602 |
| 3,894,745 | A * | 7/1975 | Heim et al. | 280/610 |
| 4,221,400 | A * | 9/1980 | Powers | 280/602 |
| 4,300,786 | A * | 11/1981 | Alley | 280/602 |
| 4,679,813 | A * | 7/1987 | Girard | 280/602 |
| 4,731,038 | A * | 3/1988 | Hancock et al. | 441/68 |
| 5,183,618 | A * | 2/1993 | Pascal et al. | 264/257 |
| 5,393,085 | A * | 2/1995 | Forneri | 280/602 |
| 5,445,403 | A * | 8/1995 | Cazaillon et al. | 280/610 |
| 5,447,322 | A * | 9/1995 | le Masson et al. | 280/602 |
| 5,496,053 | A * | 3/1996 | Abondance | 280/609 |
| 5,498,016 | A * | 3/1996 | Jodelet | 280/602 |
| 6,059,308 | A * | 5/2000 | Baudin et al. | 280/610 |
| 6,217,041 | B1 * | 4/2001 | Hauser et al. | 280/14.22 |
| 6,883,823 | B2 * | 4/2005 | Riepler et al. | 280/602 |
| 6,886,848 | B2 * | 5/2005 | Riepler | 280/602 |
| 7,011,331 | B2 * | 3/2006 | Riepler | 280/601 |
| 7,134,680 | B2 * | 11/2006 | Emig et al. | 280/602 |
| 7,264,262 | B2 * | 9/2007 | Zanco | 280/602 |
| 7,338,066 | B2 * | 3/2008 | Riepler | 280/610 |
| 7,344,150 | B2 * | 3/2008 | Poellmann | 280/607 |
| 2003/0111824 | A1 * | 6/2003 | Riepler | 280/610 |
| 2004/0100067 | A1 * | 5/2004 | Riepler et al. | 280/602 |
| 2004/0150190 | A1 * | 8/2004 | Marion et al. | 280/601 |
| 2005/0167948 | A1 * | 8/2005 | Riepler | 280/610 |
| 2005/0206129 | A1 * | 9/2005 | Stritzl et al. | 280/609 |
| 2005/0212260 | A1 * | 9/2005 | Poellmann | 280/609 |
| 2005/0248126 | A1 * | 11/2005 | Degasperi et al. | 280/601 |
| 2008/0106069 | A1 * | 5/2008 | Holzer et al. | 280/602 |
| 2008/0185816 | A1 * | 8/2008 | Riepler et al. | 280/602 |

* cited by examiner

*Primary Examiner* — Hau V Phan
*Assistant Examiner* — Jacob Meyer
(74) *Attorney, Agent, or Firm* — Welsh Flaxman & Gitler LLC

(57) ABSTRACT

In a snow glide board, in particular a ski with a glide board body, the outer surface of which is formed at least on one top side opposing the gliding or running surface by a shell of at least one layer made of a flat material and the glide board body of which comprises at least one channel extending in the longitudinal direction of the glide board body for holding at least one trim rod, the shell is made of a shell element on which at least one hollow or tubular section forming a channel for at least one trim rod is formed or pre-mounted.

4 Claims, 3 Drawing Sheets

FIG. 1
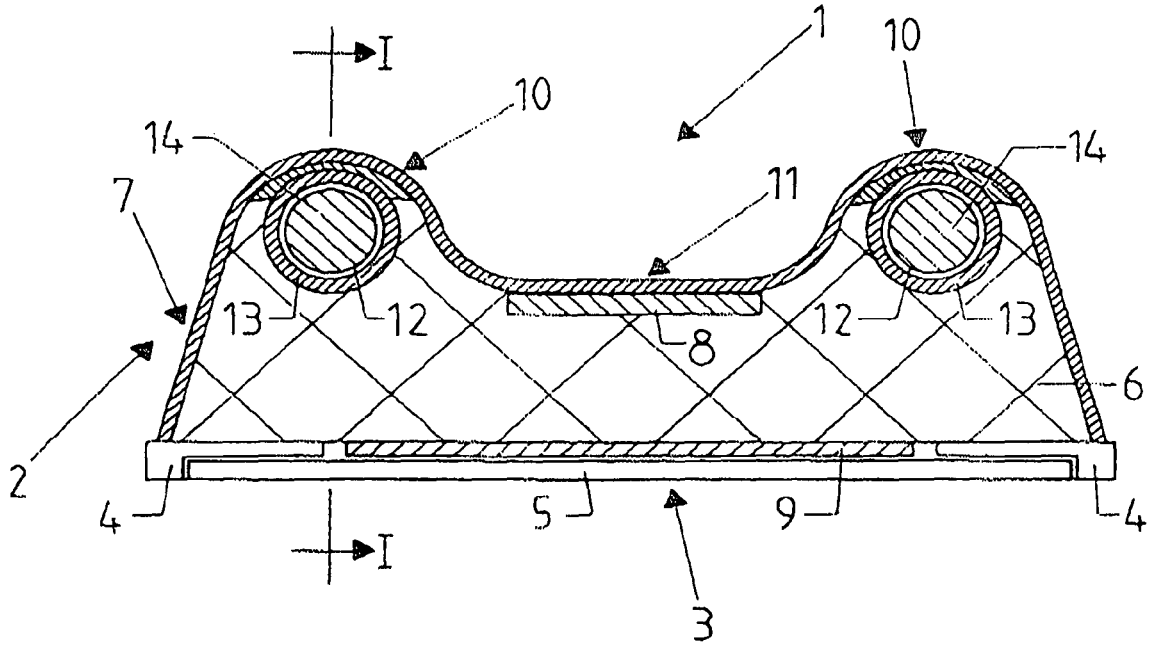
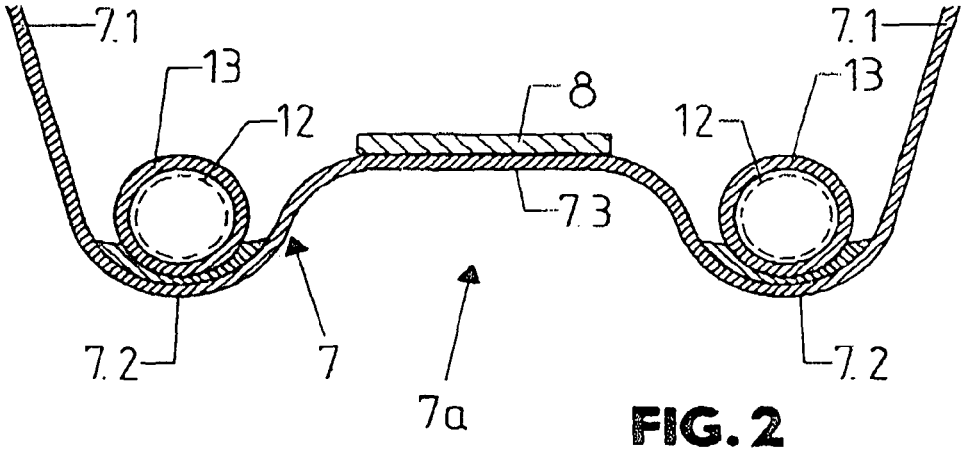
FIG. 2

SNOW GLIDE BOARD AND SHELL ELEMENT FOR A SNOW GLIDE BOARD

BACKGROUND OF THE INVENTION

The invention relates to a snow glide board, in particular to a ski, with a glide board body, the outer surface of which is formed at least on one top side opposing the gliding or running surface by a cap or shell of at least one layer made of a flat material and in which at least one channel extending in the longitudinal direction of the glide board body is provided for holding at least one trim rod.

The invention further relates to a shell element with a shell formed by at least one layer of a flat material for manufacturing a snow glide board, in particular a ski, with at least one channel formed in a glide board body and extending in the longitudinal direction of the glide board body for holding at least one trim rod.

Many various types of snow glide boards are known in the art. A design has also been proposed in which two recesses or channels extending in the longitudinal direction of the snow glide board are provided in the snow glide board body of a downhill ski, each recess for holding a replaceable trim rod, with which the mechanical, and in particular also the dynamic properties of the respective ski can be adapted to the preferences or requirements of the user. Depending on the material used, it is possible to adapt the flexural strength, the damping behavior, etc. of the snow glide board. The channels for holding the trim rods extend over a majority of the length of the glide board body, extending from the front section (blade area) of the glide board body to the back end of the glide board body. However, such snow glide boards are not suitable for economical mass production.

It is an object of the invention is to develop a snow glide board of the before mentioned type so that it is suitable for economical mass production.

SUMMARY OF THE INVENTION

An object is achieved by a snow glide board, in particular a ski with a glide board body, the outer surface of which is formed at least on one top side opposing the gliding or running surface by a cap or shell formed by at least one layer of a flat material and in which at least one channel extending in the longitudinal direction of the glide board body is provided for holding at least one trim rod, wherein the cap or shell is formed by a pre-fabricated cap element or shell element, on which at least one hollow section forming the at least one channel is formed or pre-mounted on one inner side of the shell.

This object is also achieved by a shell element for snow glide boards, the shell element comprising a shell of at least one layer made of a flat material for manufacturing a snow glide board, in particular a ski, with at least one channel formed in a glide board body and extending in the longitudinal direction of the glide board body for holding at least one trim rod, wherein the shell element is prepared on one inner side of the shell with at least one hollow section forming the at least one channel.

A special feature of the invention consists in the fact that for the manufacture of the snow glide board a shell element is used consisting of the shell forming the top side of the snow glide board body, preferably also at least partially the longitudinal sides of said glide board, and of at least one prepared hollow or tubular section on the inside of the shell, said section forming the at least one channel for holding at least one trim rod. In the manufacture of the snow glide board, this prepared shell element with the at least one hollow or tubular section is inserted with the other components or elements of the snow glide board body into the mold tool used for manufacturing and is bonded to the glide board body, for example by means of pressing with a synthetic material.

BRIEF DESCRIPTION OF THE DRAWINGS

The invention is described below based on exemplary embodiments with reference to the drawings, in which:

FIG. 1 shows a cross section of a ski according to the invention;

FIG. 2 shows in a component drawing a cross section of the shell of the ski in FIG. 1;

DETAILED DESCRIPTION OF THE INVENTION

Figure 3:
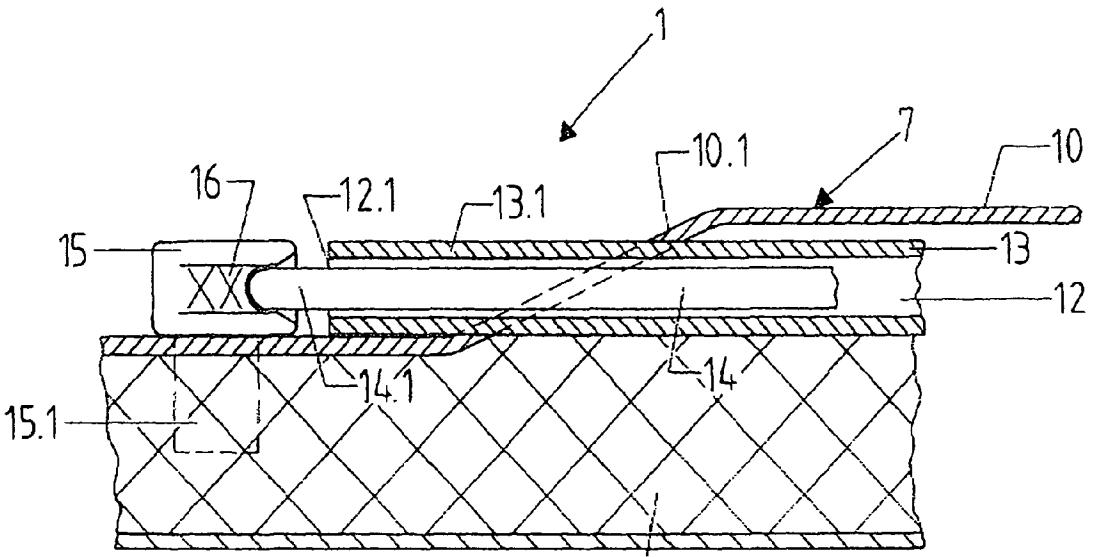
FIG. 3 shows a fragmentary longitudinal cross section of the ski in FIG. 1 in the area of one support or damping element.

The ski generally designated 1 in FIGS. 1-3 features—with the exception of the special characteristics described in the following—the usual structure, i.e. it consists of a lower running surface element 3 with the two steel edges 4 and with the running surface coating 5 forming the running surface or bottom of the ski body 2, of the core 6 made of a core material (e.g. synthetic foam and/or wood) that is suitable for snow glide boards or skis, of the cap or shell 7 forming the top of the ski body 2 and also the side surfaces of said ski body, and of an upper and lower belt-like support layer 8 and 9, made of a suitable material for such support layers or belts, e.g. metal (for example Titanal) and/or fiber-reinforced plastic and extending over the entire length of the ski body.

The ski 1 is designed as a so-called 3-D ski, i.e. the ski body 2 is provided on its top side formed by the shell 7 with two bead-shaped protrusions 10, which extend over a majority of the length of the ski body, in particular also over the middle area or binding area of the ski body 2, on which (binding area) the binding or the elements of the binding are fastened. The protrusions 10, each of which extend along one longitudinal side of the ski body 2, are tapered in the areas of the front and rear end of the ski body, i.e. they form tapered ends 10.1 there, as shown in FIG. 3. Between the two protrusions 10, the ski body 2 features a trough-shaped recess 11 on its top side.

In the area of each protrusion 10 a channel 12 is formed in the core 6 and beneath the shell 7, which (channel) likewise extends along the respective longitudinal side of the ski body 2, as does the corresponding protrusion 10. In the depicted embodiment each channel 12 is open at both ends, namely at the tapered end 10.1 of the respective protrusion 10. Each channel 12 is formed by the interior of a plastic tubular section 13, which is embedded in the core 6, namely for example by foaming, for example with a plastic foam (e.g. PUR foam) at least partially forming the core 6 or by bonding it in the core 6 with a synthetic resin used in the manufacture of the ski body 2.

The tubular section 13 in this embodiment is inserted on the respective tapered end 10.1 of the corresponding protrusion 10 with the respective end 13.1 outward through the shell 7, so that the end 13.1 of the tubular section protruding from the shell 7 there forms the channel opening 12.1 of the channel 12.

An exchangeable trim rod 14 is held in the channel 12 with an outer diameter that is equal to or less than the inner diameter of the channel 12, so that said trim rod 14 can move axially relative to the tubular section 13 with a certain amount of play. The trim rod 14 in the depicted embodiment consists of a fiber-reinforced plastic, for example of fiberglass-reinforced plastic or carbon-reinforced plastic, thus making it elastically deformable. The length of the trim rod 14 is such that, after being inserted into the channel 12, its ends 14.1 protrude from the channel openings 12.1, as shown for one end 14.1 in FIG. 3.

The trim rod 14 is supported with each end 14.1 on a bearing or support element 15, which is fastened in a suitable manner on the top of the ski body 2 opposite the respective channel opening 12.1. At least the support element 15 for the one end 14.1 of each trim rod 14 is provided on the ski body such that, for example after removing or pivoting this support element 15, it is possible to insert/remove the trim rods 14 into/from the channel 12, respectively.

The trim rods 14 can be used for example to influence the flexing or flexural strength of the ski body 2 during flexing, i.e. to adapt the flexural strength to the preferences and requirements of the individual user, namely through the use of trim rods 14 with differing flexural strength, which can be achieved through the respective choice of material and/or through a respective diameter for the trim rods 14. In order to compensate for the differences in length caused by the differing radius of bend during flexing of the ski body 2, the bearing or support surfaces for the ends 14.1 formed by the support elements 15 are elastic or resilient, i.e. in the depicted embodiment these support surfaces are formed by an insert 16 made of a permanently elastic synthetic material. The corresponding choice of material also achieves a damping effect. A further damping effect can be achieved by encasing the respective trim rod with an elastic, damping material.

The shell 7 is made of a single-layer, but preferably of a multi-layer flat synthetic material. In the multi-layer embodiment the shell 7 is made of an outer synthetic layer (e.g. surface or decorative foil) forming the outer surface of the ski body 2 and of an inner supporting layer, e.g. of a fiber-reinforced plastic. As FIG. 2 shows, the shell 7 is pre-fabricated as a 3-D shell with two sections 7.1 forming the sides of the shell 7 and of the glide board body 2, with two groove-shaped sections 7.2 on the inside of the shell forming the later protrusions 10 and with one middle section 7.3 forming the recess 11 of the glide board body 2. The shell 7 is furthermore a part of a cap element or a shell element 7*a*, namely together with the reinforcing element or belt 8 provided on section 7.3 on the inside of the shell 7. A special feature of the invention is the fact that the shell element 7*a* is pre-fabricated with the tubular section 13, i.e. one tubular section 13 is held in each groove-shaped section 7.2, fastened there in a suitable manner and inserted with its ends 13.1 through openings in the shell 7 at the ends of the respective groove-shaped section 7.2. The tubular sections 13 are held on the inside of the shell 7 for example by adhesive bonding with a suitable synthetic material.

In the depicted embodiment, the support elements 15 are also prepared on the shell 7 or on the shell element 7*a* and are inserted through the shell 7 with an anchoring section 15.1 and protrude with this section over the inside of the shell 7. The anchoring sections 15.1 are used to anchor the support elements 15 in the core 6 by packing them in foam or in another manner, for example by adhesive bonding with synthetic resin.

The prepared shell element 7*a* with the tubular sections 13 and the upper support element or belt 8 is then inserted together with the remaining elements forming the ski body 2 into the device or mold used for the manufacture of the ski body 2. To prevent the penetration in particular of synthetic material or synthetic resin in the channels 12 formed by the tubular sections 13 during the manufacture or pressing of the ski body 2, the tubular sections 13 are closed on both ends, namely such that they can be opened with a suitable tool or by simply puncturing them. The corresponding closure is formed for example by a membrane or by a removable plug.

It was assumed in the above description that each of the trim rods 14 is supported on both ends by a support element 15. Fundamentally, it is also possible to mount the trim rod 14 at only one end on a holding or bearing element fastened to the ski body 2.

It was also assumed in the above description that each of the trim rods 14 is inserted through the channel 12 on both ends. Other designs are also possible. For example, it is possible to close each channel 12 or each tubular section 13 on one end. This closed end of the respective tubular section, preferably not inserted through the shell 7, then forms for example a support bearing for one end 14.1 of the respective trim rod 14, or the trim rod 14 mounted on its other end is held in the channel 12 at a distance from the closed end.

Figure 4:
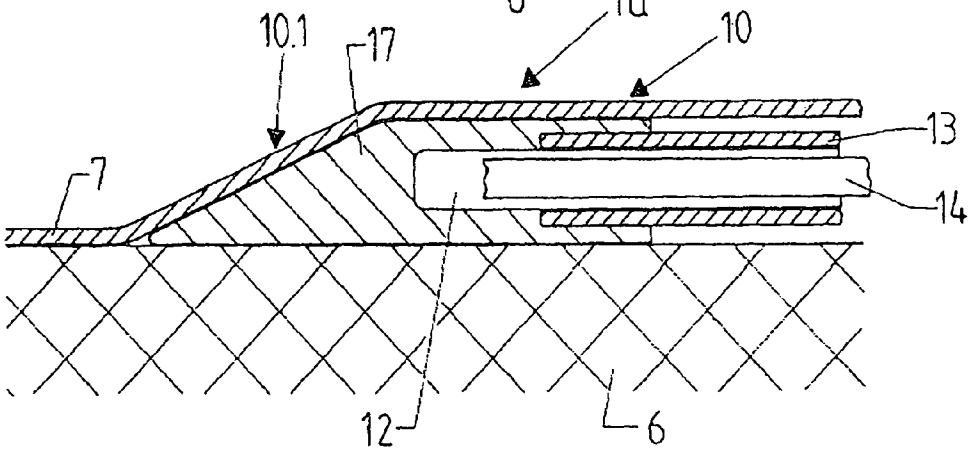
FIGS. 4 and 5 show further possible embodiments in representations similar to FIG. 3.

FIG. 4 shows, as a further embodiment of the invention, a simplified fragmentary view of a ski 1*a*, in which the channels 12 formed by the tubular sections 13 are each closed on one end in the manner described above and for this purpose are designed or provided with an end piece 17. The end pieces 17, which for example are manufactured as molded or injection molded parts from plastic, are adapted to the inner shape of the groove-shaped section 7.2 at the tapered end 10.1 of the protrusions 10 and held by suitable means, for example by adhesive bonding, to the inside surface of the shell 7, which is closed at least in this area.

Figure 5:
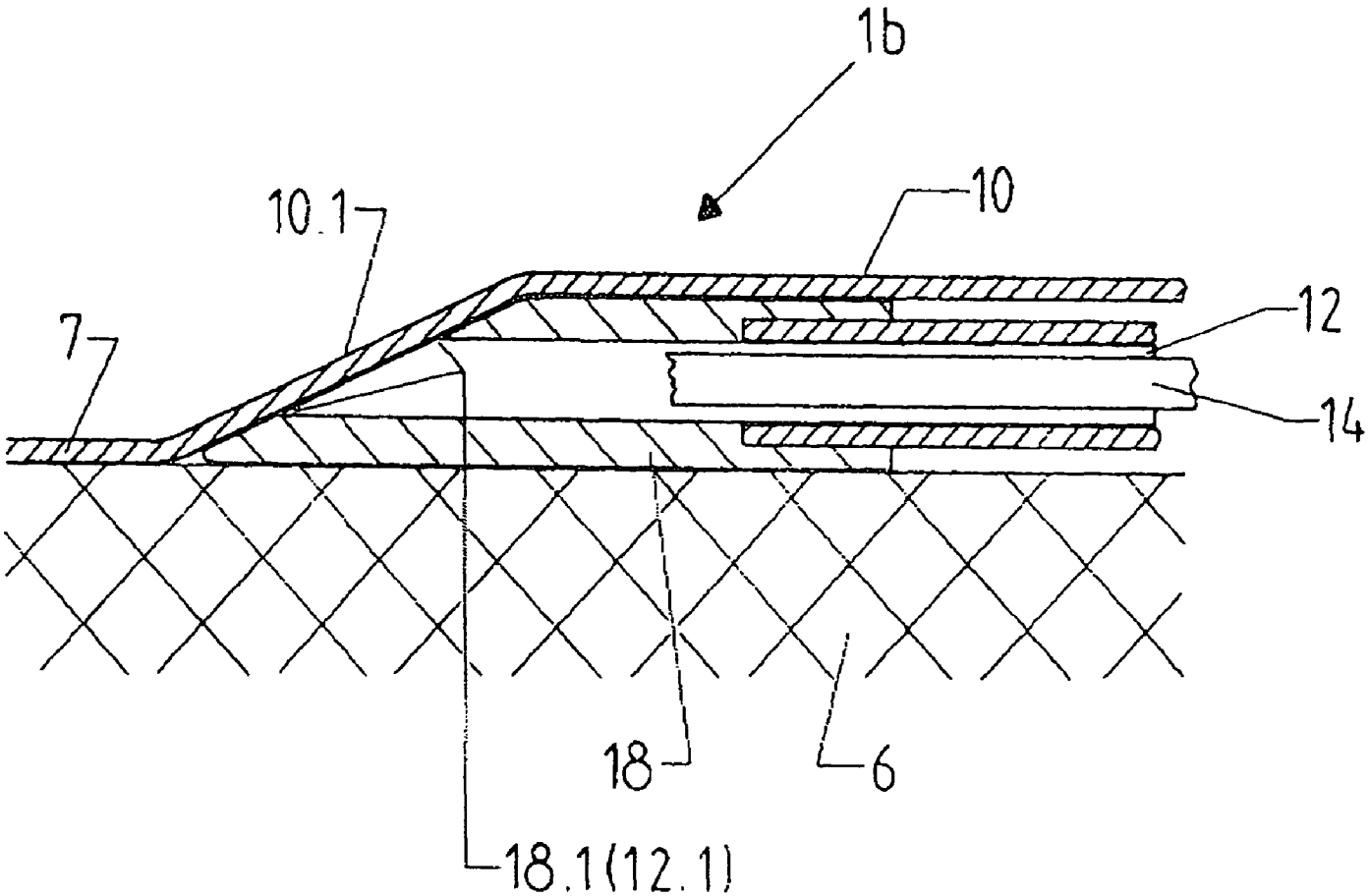

FIG. 5 shows, as a further embodiment, a fragmentary view of a ski 1*b*, in which the tubular sections 13 are designed or provided with an end piece 18 on at least one end. The end pieces 18, which again are for example molded or injection molded plastic parts, form with their openings 18.1 in this embodiment the channel openings 12 and are fastened on the inside surface of the shell 7 on the section 7.2 for example by adhesive bonding or welding, namely in the area of the tapered end 10.1. The respective end piece 18 is also fastened in particular so that the respective opening 18.1 of each end piece 18 forming the channel opening 12.1 is tightly closed by the shell 7, thus preventing the penetration of foreign material, in particular also synthetic material, into the channel 12 during manufacture of the ski 1*b*. The shell 7 is not opened in the area of the channel opening 12.1 until after manufacture of the ski 1*b*, for example with a suitable tool and/or by providing the shell 7 there with an easily removable area, e.g. by means of perforation and/or reduced material thickness of the shell 7, etc. After opening the respective channel 12, the trim rod 14 can be inserted into said channel through the channel opening 12.1. If no trim rod is needed, for example, then the shell 7 remains closed in the area of the end pieces 18.

The invention was described above based on various exemplary embodiments. It goes without saying that numerous modifications are possible, without abandoning the underlying inventive idea upon which the invention is based. For example, the trim rods 14 can be designed with different characteristics than those described above, also with respect to their mechanical properties, for example so that the trim rods are made over their entire length or a partial length of a damping material that is deformable during flexing of the respective ski, e.g. a flexible material.

Furthermore, it is possible to design the end pieces that are used, for example the end piece 18, so that the end piece simultaneously forms the support element or bearing element for the respective trim rod.

Furthermore, it is possible for each trim rod to consist of a bundle of single rods with the same or differing mechanical properties. All embodiments have in common that, for the manufacture of the ski, a shell element 7*a* is used, on the shell 7 of which at least one channel is already prepared for holding at least one trim rod, thus ensuring the economical manufacture of the respective ski or snow glide board.

REFERENCE LIST

1, 1*a*, 1*b* ski
2 ski body
3 running surface component
4 steel edge
5 running surface
6 core
7 shell
7.1, 7.2, 7.3 section of shell 7
8, 9 support layer or belt
10 protrusion
10.1 tapering end of protrusion 10
11 trough-shaped recess
12 channel
12.1 channel opening
13 tubular section
13.1 end of tubular section 13
14 trim rod
14.1 end of trim rod
15 support element
16 insert
17, 18 end piece
18.1 opening of end piece 18

What is claimed is:

1. A snow glide board comprising:

a glide board body having an outer surface and a gliding surface, the outer surface is formed at least on a top side of the glide board body opposing the gliding surface, the outer surface is composed of a shell of at least one layer made of a flat material and at least one channel is formed within the shell along an inner surface of the shell, the at least one channel extends in a longitudinal direction of the glide board body and holds at least one trim rod, at least one hollow section forming the at least one channel formed along the inner surface of the shell, wherein the at least one hollow section includes an open end and is positioned within the shell along at least on one end of the at least one channel for receiving the at least one trim rod such that the at least one trim rod is mounted outside the at least one channel, and at least one bearing element is fastened to the glide board body opposite the open end of the hollow section for selectively retaining the at least one trim rod within the at least one channel.

2. The snow glide board as claimed in claim 1, wherein an outer diameter of the at least one trim rod is equal to or less than the inner diameter of the at least one channel, so that the at least one trim rod can move axially relative to the at least one hollow section, and wherein at least one trim rod is exchangeable.

3. A shell element comprising:

a shell having at least one layer made of a flat material for manufacturing a snow glide board including a glide board body, at least one channel formed within the shell of the glide board body and extending in a longitudinal direction of the glide board body for holding at least one trim rod, wherein the shell element is a pre-fabricated element comprising at least one hollow section forming the at least one channel formed along an inner surface of the shell, and wherein the hollow section includes an open end and is positioned within the shell along at least on one end of the at least one channel for receiving the at least one trim rod such that the at least one trim rod is mounted outside the at least one channel, and at least one bearing element is fastened to the glide board body opposite the open end of the hollow section for selectively retaining the at least one trim rod within the at least one channel.

4. The snow glide board as claimed in claim 3, wherein an outer diameter of the at least one trim rod is equal to or less than the inner diameter of the at least one channel, so that the at least one trim rod can move axially relative to the at least one hollow section.

* * * * *